US005672560A

United States Patent [19]

Rush

[11] Patent Number: 5,672,560

[45] Date of Patent: Sep. 30, 1997

[54] STABILIZED HEAT-SENSITIVE IMAGING MATERIAL

[75] Inventor: Kent R. Rush, Rochester, N.Y.

[73] Assignee: Labelon Corporation, Canandaigua, N.Y.

[21] Appl. No.: 666,869

[22] Filed: Jun. 17, 1996

[51] Int. Cl.[6] ..... B41M 5/30

[52] U.S. Cl. ..... 503/209; 503/202; 503/212

[58] Field of Search ..... 503/208, 209, 503/212, 201, 200, 202, 226; 427/150–152

[56] References Cited

U.S. PATENT DOCUMENTS

| | | | |
|---|---|---|---|
| 5,175,138 | 12/1992 | Akutsu et al. | 503/209 |
| 5,296,440 | 3/1994 | Kanda et al. | 503/208 |
| 5,424,182 | 6/1995 | Marginean, Sr. et al. | 430/617 |
| 5,432,534 | 7/1995 | Maruyama et al. | 347/172 |
| 5,514,636 | 5/1996 | Takeuchi | 503/207 |
| 5,525,571 | 6/1996 | Hosoi | 503/200 |

*Primary Examiner*—Bruce H. Hess
*Attorney, Agent, or Firm*—Nixon, Hargrave, Devans & Doyle

[57] ABSTRACT

The present invention is directed to a heat-sensitive imaging material that comprises a support on which is formed a heat-sensitive imaging layer. This imaging layer comprises a color-forming amount of a substantially colorless, finally divided noble metal salt of an organic acid, an organic reducing agent that is capable of a color-forming reaction with the noble metal salt under heating conditions to produce a colored image, and a stabilizer compound of formula (I) that mitigates the formation of non-imaging background color in the imaging layer:

(I)

In formula (I), $Z_1$, $Z_2$, and $Z_3$ each independently represents hydrogen, an alkali metal ion, an alkyl group comprising 1 to about 8 carbon atoms, an aralkyl or cycloalkyl group comprising 5 to about 10 carbon atoms, or an aryl group comprising 6 to about 15 carbon atoms; or $Z_1$ and $Z_2$ together represent a divalent alkaline earth metal ion, a divalent alkylene group comprising 2 to about 8 carbon atoms, or a divalent aryl group comprising 6 to about 30 carbon atoms; with the proviso that, when $Z_1$ and $Z_2$ together do not represent a divalent alkaline earth metal ion, at least one of $Z_1$, $Z_2$ and $Z_3$ represents hydrogen or an alkali metal ion.

19 Claims, 1 Drawing Sheet

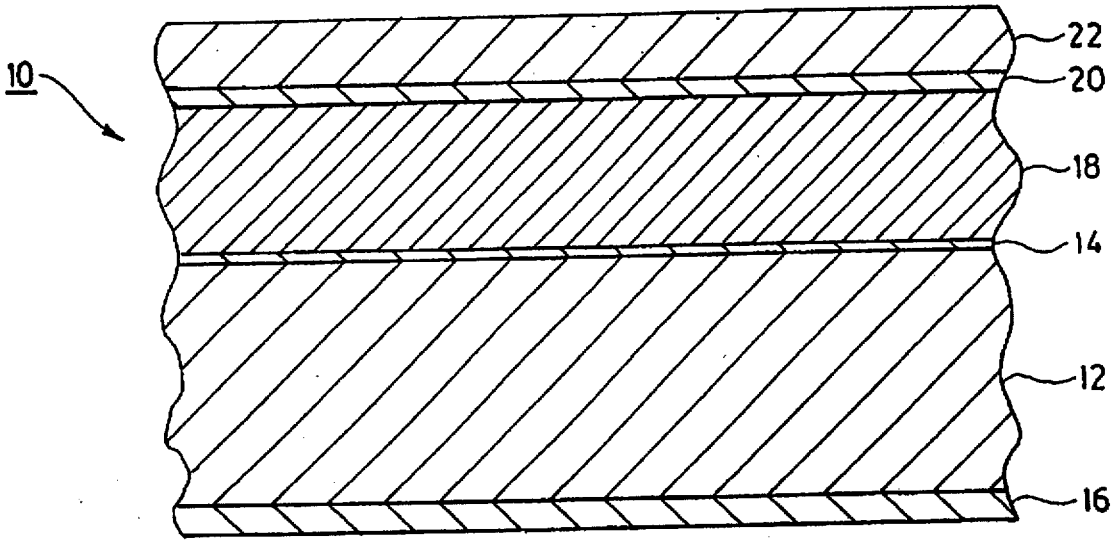
10
22
20
18
14
12
16

STABILIZED HEAT-SENSITIVE IMAGING MATERIAL

FIELD OF THE INVENTION

This invention relates to heat-sensitive imaging materials and more particularly to a dry silver thermal imaging material of improved stability against non-imagewise partial silver development.

BACKGROUND OF THE INVENTION

In the past several years, direct thermal imaging by thermal imaging printers has become a popular method for recording documents and data due to the low cost and reliability of equipment. Infrared imaging is also a convenient and inexpensive way to produce monochrome thermal transparencies for overhead projector presentations. Technology commonly used for direct thermal printing devices is well known and described in U.S. Pat. Nos. 4,289,535 and No. 4,675,705, where colorless or pale colored chromogenic dyestuffs are combined with a color-developing agent such as benzyl p-hydroxybenzoate or 4,4'-isopropylidenediphenol. This technology, however, is not well suited for the manufacture of single sheet, transparent films for overhead projection presentations.

"Dry silver" thermal imaging technology is commonly used to produce single sheet, transparent black image films and is described in, for example, U.S. Pat. Nos. 3,080,254, 3,031,329, 3,446,648 and 5,026,606, the disclosures of which are incorporated herein by reference. In such dry silver thermal imaging systems, an imaging layer typically comprises a silver salt of an organic fatty acid, a developer that is mobile at printing temperatures, and appropriate binders, hardeners, toning agents and modifying agents. Depending on the intended use, this layer is coated on a reflective or transparent base. A protective layer over the imaging layer and a back coat on the reverse side of the base typically completes the imaging element. The silver salt of the organic acid, preferably silver behenate or silver stearate, is reduced by the developer, which is preferably an incorporated organic reducing agent such as an alkyl ester of gallic acid, to produce, in the presence of a toning agent, a dense black image.

This art also teaches that resin binders suitable for the carrier system of the inventions are only those which are soluble in organic solvents such as methyl ethyl ketone, acetone, and heptane. The use and disposal of organic solvents, however, raises environmental and worker safety concerns. These solvents are inherently flammable or explosive and their use requires specially-adapted and expensive manufacturing equipment. In addition, they are effluent of the manufacturing process and must be recovered or burned, thus adding to the cost of manufacture.

Furthermore, the single sheet transparency compositions commercially available for use in direct thermal printing applications have been found to cause sticking of the imaging material to the print head, and have had insufficient sensitivity or thermal response characteristics to produce an adequately dense black output. In addition, commercially available compositions frequently exhibit low maximum density (D-max), high minimum density (D-min), and high light scatter or haze.

Thus, there exists a continuing need for thermal imaging materials that can be manufactured safely and with no adverse environmental impact, will produce images of great clarity with little haze, very high maximum density, and low minimum density, and will not stick to the print head or cause melted material to accumulate on the print head.

U.S. Pat. No. 5,424,182, the disclosure of which is incorporated herein by reference, discloses useful aqueous, heat-sensitive compositions used to make multilayer heat-sensitive materials. The materials comprise a color-forming layer, itself comprising a color-developing amount of finely divided, solid colorless noble metal salt of an organic acid, preferably silver behenate, and a color-developing amount of an alkyl ester of gallic acid, an image toning agent such as phthalazone, and a carrier composition.

While a protective layer normally covers the color image-forming layer of the compositions disclosed above, undesired partial silver development can still readily occur at moderately high temperatures, e.g., at or above about 120° F. (49° C.). Exposure to such temperatures, leading to unacceptable background density increases in the thermal imaging material, can occur, for example, in thermal printers that generate excessive heat during operation or during exposure to hot environments, such as are commonly encountered in warehouses or shipping docks. While the addition of various stabilizers to thermal imaging materials has been proposed to eliminate the above-stated problems, most stabilizers for solvent-coated systems are ineffective in aqueous-coated systems.

U.S. Pat. Nos. 5,175,138 and 5,296,440 disclose the use of certain organic phosphates and their salts as stabilizers in non-silver heat-sensitive materials containing basic leuco dyes. The particular disclosed phosphates are reported to improve the stability by interacting with the dyes and inhibiting fading of recorded images in D-max areas. However, these compounds appear to have little effect on fogging in non-image D-min areas.

SUMMARY OF THE INVENTION

The present invention is directed to a heat-sensitive imaging material that comprises a support on which is formed a heat-sensitive imaging layer. This imaging layer comprises a color-forming amount of a substantially colorless, finally divided noble metal salt of an organic acid, an organic reducing agent that is capable of a color-forming reaction with the noble metal salt under heating conditions to produce a colored image, and a stabilizer compound of formula (I) that mitigates the formation of non-imaging background color in the imaging layer:

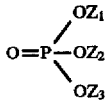

(I)

In formula (I), $Z_1$, $Z_2$, and $Z_3$ each independently represents hydrogen, an alkali metal ion, an alkyl group comprising 1 to about 8 carbon atoms, an aralkyl or cycloalkyl group comprising 5 to about 10 carbon atoms, or an aryl group comprising 6 to about 15 carbon atoms; or $Z_1$ and $Z_2$ together represent a divalent alkaline earth metal ion, a divalent alkylene group comprising 2 to about 8 carbon atoms, or a divalent aryl group comprising 6 to about 30 carbon atoms; with the proviso that when $Z_1$ and $Z_2$ together do not represent a divalent alkaline earth metal ion, at least one of $Z_1$, $Z_2$ and $Z_3$ represents hydrogen or an alkali metal ion.

BRIEF DESCRIPTION OF THE DRAWING

FIG. 1 shows an embodiment of a heat-sensitive film or paper according to the invention.

DETAILED DESCRIPTION OF THE INVENTION

The heat-sensitive imagining material of the present invention exhibits improved imaging characteristics when used in infrared copying machines, such as a 3M Model 45 infrared copier, as well as in commercially available direct thermal printing devices such as wide format direct thermal plotters sold by CalComp under the trademark DrawingMaster Plus. The composition of the present invention is typically used in a composite multilayer film configuration wherein the color forming layer comprises a color-forming amount of a finely divided, solid colorless noble metal salt of an organic acid; a color-developing amount of an organic reducing agent that at thermal copy and printing temperatures is capable of a color-forming reaction with the noble metal salt; an image toning agent; a phosphate stabilizer compound that lessens the formation of non-imagewise color; and a carrier composition in which the noble metal salt, organic reducing agent, stabilizer, and image toning agent are distributed, comprising one or more substantially water-soluble polymeric carrier materials and a solubility-enhancing amount of a dispersing agent.

The composite film preferably further includes a protective overcoat layer comprising a radiation-curable composition that includes a blend of one or more reactive monomers which, when sufficiently cured, will melt, soften, or decompose only at temperatures greater than those attained by commercially available thermal printheads or infrared copy machines. Preferably, the overcoat composition further includes one or more photoinitiators capable of sufficiently polymerizing the said reactive monomers, a dry lubricant, and a mildly abrasive filler.

The composite film may optionally include an intermediate layer comprising a substantially water-soluble or dispersible polymeric material capable of promoting adhesion between the color-forming layer and the protective overcoat layer.

Referring to FIG. 1, embodiment 10 of the invention comprises substrate or support 12, which may be, for example, paper, glass, or a plastic sheeting or film. Suitable film-forming plastic substrates are, for example, poly (ethylene terephthalate), polyolefin, polycarbonate, polysulfone, polystyrene, and cellulose acetate. Support 12 can be transparent, translucent, or opaque, and is typically provided with adhesion or subbing layer 14. One or more backing layers 16 may be provided to control physical properties such as curl or static. An example of a suitable, commercially available support is Melenex 6093, available from ICI, Ltd., which comprises 2.65-mil poly(ethylene terephthalate), subbed on one side and carrying on the other side an antistatic coating showing a resistance of about $2\times10^{10}$ ohms. Disposed on subbing layer 14 is color-forming layer 18 comprising a heat-sensitive coated composition. Tie layer 20 can be optionally included to improve adhesion between color-forming layer 18 and protective, clarifying overcoat 22.

The stabilizers of the present invention are effective in aqueous-coated systems with any dry silver imaging media. The stabilizers act to significantly improve the stability of aqueous-coated dry silver imaging media in high temperature and/or high humidity environments. The stabilizers are inorganic and organic compounds containing functional phosphate groups and are most effective when added to the dry silver imaging media as a water-soluble alkali metal salt or as a very small solid particle dispersion. At least one free or ionized —OH group must be present in the phosphate group of the compound for it to be an effective stabilizer. It has been found that fully esterified phosphates are ineffective as stabilizers.

In formula (I), $Z_1$, $Z_2$ and $Z_3$ may individually represent hydrogen, an alkali metal ion, particularly sodium and potassium, an alkyl group comprising up to about 8 carbon atoms, branched or unbranched, substituted or unsubstituted, for example, methyl, ethyl, n-propyl, isopropyl, n-butyl, sec-butyl, pentyl, hexyl, 2-ethylhexyl, octyl, t-octyl, carboxyethyl, ethoxyethyl, 3-hydroxypropyl, and 1,3-dihydroxy-2-propyl. $Z_1$, $Z_2$ and $Z_3$ may also represent an aralkyl group such as, for example, benzyl and phenethyl, cycloalkyl groups such as, for example, cyclopentyl and cycloalkyl, and substituted and unsubstituted aryl groups, such as, for example, phenyl, o-tolyl, p-tolyl, p-carboxylphenyl, m-chlorophenyl; m-methoxyphenyl, and 2,4-dimethoxylphenyl.

Also in formula (I) $Z_1$, and $Z_2$ together may represent an alkaline earth metal ion such as, for example, calcium and magnesium, or a divalent alkylene group such as, for example, ethylene, propylene, butylene, 1,2-hexylene, 2,5-hexylene, and 1,2-octylene. $Z_1$, and $Z_2$ together may also represent a divalent aryl group such as, for example, 2,2'-methylenebisphenyl, 2,2'-ethylidenebisphenyl, 2,2'(2-propylidene) bisphenyl and 1,8-naphthylene.

Preferred stabilizers include phosphoric acid, tribasic, dibasic, and monobasic phosphate salts with alkali and alkaline earth metal ions; organic phosphate esters and derivatives thereof, including diphenyl phosphate, bis(2-ethylhexyl) phosphate glyceryl 2-phosphate, and alkali metal salts thereof. Other preferred phosphate stabilizers include 2,2'-methylenebis(4,6-di-tert-butylphenyl) phosphate and derivatives thereof, sodium 2,2'-methylenebis(4,6-di-tert-butylphenyl) phosphate being particularly preferred and having the formula (II):

(II)

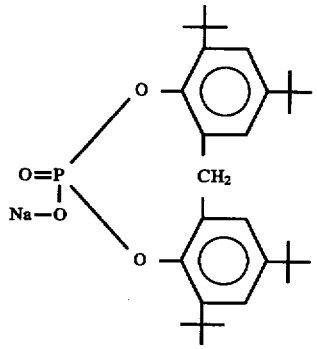

The compound of formula (II), which is referred to as Stabilizer F85, is available from Asahi-Denka Kogyo K. K., Japan.

In the novel color-forming layer of the present invention, the preferred color-forming noble metal organic acid salt is silver behenate, which is colorless, stable toward light, and insoluble in an aqueous vehicle. Silver stearate may be successfully substituted for silver behenate, and silver and gold salts of many other organic acids have also been found useful in heat-sensitive compositions and copying papers as previously described in U.S. Pat. No. 3,080,254, the disclosure of which is incorporated herein by reference. A partial list of such organic acids suitable for use in the present invention includes oleic, lauric, hydroxystearic, acetic, phthalic, terephthalic, butyric, m-nitrobenzoic, salicyclic, phenylacetic, pyromellitic, p-phenylbenzoic, undecylenic, camphoric, furoic, acetamidobenzoic and o-aminobenzoic. While this invention describes the use of noble metal salts, it is also known that salts of iron can be used in applications where slight background color is acceptable.

Reducing agents which have been found useful with such compounds in the formulation of heat-sensitive copysheets include: pyrogallol; 4-azeloyl-bis-pyrogallol; 4-stearoyl pyrogallol; galloacetophenone; di-tertiary-butylpyrogallol; gallic acid anilide; methyl gallate; ethyl gallate; propylgallate; isopropyl gallate; butyl gallate; dodecyl gallate; gallic acid; ammonium gallate; ethyl protocatechuate; cetyl protocatechuate; 2,5-dihydroxy benzoic acid; 1-hydroxy-2-naphthoic acid; 2-hydroxy-3-naphthoic acid; phloroglucinol; catechol; 2,3-naphthalenediol; 4-lauroylcatechol; sodium gallate; protocatechualdehyde; 4-methyl esculetin; 3,4-dihydroxy benzoic acid; 2,3-dihydroxy benzoic acid; hydroquinone; 4,4'dihydroxy-biphenyl; dihydroxyphenylacetic acid; 4-(3',4'-dihydroxyphenylazo)benzoic acid; 2,2'-methylene bis-3,4,5-trihydroxybenzoic acid; ortho- and para-phenylenediamine; tetramethylbenzidine; 4,4',4"-diethylamino triphenylmethane; o-, m-, and p-aminobenzoic acids; alpha- and beta naphthols; 4-methoxy, 1-hydroxydihydronaphthalene; and tetrahydroquinoline. Those compounds are cyclic or aromatic compounds having an active hydrogen atom attached to an atom of carbon, oxygen or nitrogen which in turn is attached to an atom of the cyclic ring. They are capable of causing the reduction of noble metal ions and precipitation of metallic noble metals.

The preferred organic reducing agents are those which are alkyl esters of gallic acid (3,4,5-trihydroxybenzoic acid), for example, methyl, ethyl, propyl, octyl, dodecyl and cetyl esters. Especially preferred are ethyl, propyl and octyl gallates.

The amount of color-forming noble metal salt and organic reducing agent will vary, largely depending upon the particular noble metal salt being used and the desired shade and intensity of color in the produced colored marks. Generally, the amount of color-forming metal salt present in the composition of the color-forming layer will vary from 10% to 60%, by weight, preferably from 25% to 40%, and most preferably from 30% to 35% on a percent solids basis, i.e., without taking into account the water in which the composition is ultimately dissolved or dispersed. The amount of organic reducing agent in the composition of the color-forming layer will vary from 2% to 25%, by weight, preferably from 3% to 10%, and most preferably from 4% to 8% on a percent solids basis.

Both the color-forming salt and the organic reducing agent must be homogeneously distributed through the composition. The metal salt should be in finely divided form, preferably as particles having a size of from about 0.5 to 10 microns, most preferably, 1 to 3 microns.

1(2H)-Phthalazinone, also known as phthalazone, is the preferred material for use as a toning agent and is more fully described in U.S. Pat. No. 3,080,254, the disclosure of which is incorporated herein by reference. Other suitable materials that can also be used as the toning agent include barbituric acid, 2-benzoxazolethiol, and 1-acetal-2-thiohydantoin.

Generally, the amount of phthalazone in the color-forming layer can be from 2% to 25%, by weight, preferably from 3% to 15%, and most preferably from 4% to 6%. In these amounts, the weight ratio of the noble metal salt to phthalazone will be between about 4:1 to 8:1 with a weight ratio of about 6:1 being most preferred. The phthalazone is preferably ground with the noble metal salt to a particle size of from 0.5 to 10 μm, and most preferably 1 to 3 μm.

A carrier composition in which the noble metal salt, organic reducing agent, and phthalazone are typically distributed comprises one or more substantially water-soluble, fully or partially-hydrolyzed grades of polyvinyl alcohol. The preferred degree of hydrolysis is from about 87% to 89%. The viscosity of the composition can be readily adjusted to any level by varying the amount of polyvinyl alcohol or by selection of higher or lower molecular weight.

Other water-soluble polymeric materials suitable for use with or in place of the polyvinyl alcohol carrier material in this invention include methyl cellulose, carboxymethyl cellulose, polysaccharide gums, gelatins, styrene butadiene copolymers, hydroxylated corn starch, acrylic latexes, vinyl acetate copolymers, and blends or mixtures thereof. Generally, the total amount of carrier in the composition of the color-forming layer will be between 10% and 60%, by weight, preferably from 25% to 50%, and most preferably from 40% to 50%.

The coating composition may also optionally include common wetting agents, surfactants, and various additional components for enhancing the properties of the composition such as anti-foggants, coating aids, and hardeners for the polyvinyl alcohol or other carrier materials.

Suitable anti-foggants are well-known photographic anti-foggants such as mercaptobenzotriazole, chromate, oxalate, citrate, carbonate, benzotriazole (BZT), 5-methylbenzotriazole, 5,6-dimethylbenzotriazole, 5-bromobenzotriazole, 5-chlorobenzotriazole, 5nitrobenzotriazole, 4-nitro-6-chlorobenzotriazole, 5nitro-6-chlorobenzotriazole, 4-hydroxy-6-methyl-1,3,3a,7-tetraazaindene, benzimidazole, 2-methylbenzimidazole, 5-nitrobenzimidazole, 1-phenyl-5-mercaptotetrazole (PMT), 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-aminothiodiazole, dimethyldithiocarbamate, and diethyldithiocarbamate.

Anti-foggants having relatively low solubility are preferred. Especially preferred are those having a $pK_{sp}$ of from about 14 to about 20.

Boric acid is an example of a suitable hardener for the polyvinyl alcohol carrier material. Other suitable materials are hardening and crosslinking materials known to those skilled in the art.

Surfactants and wetting agents, such as FC-129 (an anionic fluoro-surfactant consisting of 50% potassium fluoroalkyl carboxylates dissolved in 2-butoxyethanol, ethyl alcohol and water, available from 3M Industrial Chemical Products Division in St. Paul, Minn.) may also be incorporated into the coating composition to prevent repellency defects such as "fisheyes" or spots. Such surfactants can be present in the composition of the color-forming layer at a concentration of from about 0.01% to about 0.5% based on the weight of the composition.

The total concentration of these and other various addenda in the final coating composition can range from about 0.01% to about 5% of the composition on a percent solids basis. By "percent solids basis" is meant the weight percent based on the combined weight of the non-aqueous components of the coating composition. Depending on the particular materials employed, the various addenda may be incorporated in or ground with the color-forming metal salt and other components to be finely divided, or dissolved in the solution or dispersion of the carrier material in water.

Preferably, the silver salt, toning agent and other materials to be finely ground are mixed and ground together in a dispersion or solution of the carrier material in water. The silver salt composition is ground to an average particle size of from about 0.5 to about 3 μm, and the reducing agent is dissolved in a solution of polyvinyl alcohol, dispersing agent, and water. The resulting silver salt grind and reducing agent compositions are then mixed together into a single coating composition which can be applied to a support after optional further dilution with water. The total amount of water present in the color-forming layer coating composition can range from 40% to 95%, preferably 60% to 85%.

The color-forming layer coating composition can be coated at a coating flow rate to yield a dried coverage of from about 0.5 to about 3.0 lb/MSF, preferably from about 0.9 to about 2.2 lb/MSF. By "lb/MSF" is meant pounds per 1000 square feet.

The composition is coated and passed through a drying tunnel at a rate of about 100 to about 200 feet per minute, at a drying temperature of from about 140 to about 200 degrees F., depending upon the coating speed. The water is evaporated from the coating leaving color-forming layer 18 adhered to subbing layer 14 and thereby to support 12.

When using a plastic support any suitable, compatible material may be used as listed hereinbefore. Alternatively, the color-forming layer coating composition may be applied to paper or other support.

As previously stated, the compositions of the present invention may be used in films suitable for thermal copying as well in direct thermal printing films comprising (1) of substrate or support formed from a flexible material, (2) a color-forming layer of the thermally imageable material of the present invention applied to at least one surface of the substrate, (3) an optional intermediate layer capable of promoting intercoat adhesion between the color-forming layer and (4) a protective, clarifying overcoat having sufficient hardness and frictional properties to allow for direct thermal recording. In this embodiment, the composite layers produce a film transparent to visible, UV and infrared light. The coated layers are sufficiently flexible that the substrate bearing them can be imaged in commercially available infrared copying machines and can be wound into rolls or used as sheets in commercially available direct thermal printing devices.

In some applications it has been found useful to incorporate an optional intermediate layer or "tie" coat that promotes adhesion between the color-forming layer and the protective overcoat. The use of an intermediate layer has been particularly useful to avoid polymer incompatibility that can occur when adhesion promoting resins are added to the color-forming layer. Styrene butadiene copolymers are especially preferred for this purpose. Other materials that work well are polyvinyl acetate copolymers and polyurethanes.

Generally, the concentration of the intermediate layer adhesion-promoting material will vary from 5% to 50%, by weight to deionized water, preferably from 10% to 20% and most preferably from 15% to 18%. The intermediate layer may also contain wetting agents, surfactants and various additional components for enhancing properties of the composition. Other conventional materials or additives that promote adhesion can also be included in the composition without departing from the spirit of the invention. Similarly, these additives or materials can be added directly to the color-forming layer and be considered within the scope of the invention.

The use of an overcoat layer serves multiple purposes. The primary function of the overcoat in the present invention is to achieve maximum optical clarity. A second function, also important, is to provide protection for the color-forming layer against fingerprinting and abrasion during normal handling of the transparency sheets, and also from exposure to the elements, particularly moisture, at elevated temperature and humidity. An overcoat layer resistant to various common hazards is highly beneficial to the user.

Appropriate materials for an overcoat composition must meet several demanding requirements. Although many materials are suitable to achieve clarity and protection from the elements, they frequently fall short in other properties such as, for example, being environmentally safe or solvent free, having good frictional properties that affect feed properties in various thermal printing devices, or exhibiting non-sticking properties both to thermal printheads and to various laser- or toner-based originals. The overcoat must be chemically compatible with the underlying color-forming layer, neither hindering its image-forming capability nor promoting non-imagewise color formation.

Certain radiation curable materials meet all of the above desired characteristics and requirements. The selected resins offer superior optical clarity and exhibit exceptional protection from, particularly, moisture and heat. A non-overcoated color-forming layer typically appears hazy, which is thought to result from light scattering at the surface of the color-forming layer. The addition of an overcoat yields a heat-sensitive material of exceptional optical clarity. In this regard, radiation-curable overcoats are markedly superior to non-cured overcoats. Since radiation curable coatings are typically manufactured and coated as a liquid at 100% solids, they are solvent-free, and thereby enjoy the safety and cost benefits noted hereinabove.

Sticking of the image-forming material against a hot print head can be prevented by the selection of monomers or oligomers of varying molecular weight and composition to control hardness, flexibility, and melting or softening point. It is also possible to eliminate sticking by selecting polymers which have no glass transition temperature ($T_g$) or melting point ($T_f$) but which rather decompose without residue. Selection of the photoinitiator also must be based on degree of cure or polymerization required for the particular application.

The curable overcoat composition can comprise one or more acrylic or vinylic monomers, a photoinitiator and, typically, a wetting agent. Other materials, such as surfactants, slip agents, dry lubricants, mar resistance agents, and inert fillers may optionally be included in order to enhance the properties of the overcoat layer.

Examples of suitable slip agents, which also increase the mar resistance of the overcoat layer, are silicone compounds such as modified or unmodified dimethyl polysiloxanes, including the polyether modified, polyester modified, and polyester modified reactive dimethylpolysiloxanes sold by BYK-Chemie USA of Wallingford, Conn. under the trademarks BYK®-300, -301, -302, -307, -310, -320, -321, -322, -325, -330, -331, -336, -341, -344, -351, -370, -085, and other similar materials. Other suitable materials include acrylic and methacrylic functional silicones such as BYK®-371 sold by BYK Chemic, those available from Hüls America, Inc. of Piscataway, N.J. under the designations H üls PS560, PS583, PS802, PS851, PS852, PS853, PS854, PS406, PS901, PS9015, and the product sold by Dow Corning as Additive 28. These and other known slip agents may be used either alone or in combination, at concentrations ranging from about 0.05 to about 5%, preferably from about 0.05 to about 3.0% of the total overcoat composition. Such materials may be incorporated in order to prevent sticking of the imaging member to the thermal print head, as well as to increase the mar resistance of the final product.

The overcoat composition may also include inert filler materials that serve to prevent the accumulation of debris on the print head and to reduce the coefficient of friction for proper transport through the thermal printing apparatus. Suitable filler materials are those which have mild abrasive properties and high oil absorption characteristics, for example, in the range of from about 40 g to about 150 g oil/100 g filler, and an average particle size of about 1.1 μm. Aluminum oxide (alumina) having an average particle size of about 1.0 to about 5.0 μm is a preferred filler material. Other suitable filler materials include barium sulfate, calcium carbonate, clays, synthetic silicas, silica, titanium dioxide, zinc oxide, talc, chromium oxide, aluminum hydrates, fluorinated polyethylene, and microcrystalline waxes. Such filler materials can be present in the overcoat composition at amounts of from about 0.5% to about 5% by weight of the total composition, preferably from about 0.9% to about 2% of the total.

Suitable dry lubricants in the overcoat composition comprise the metal salts of long-chain aliphatic carboxylates, for example, zinc stearate and calcium stearate.

Examples of suitable radiation-curable monomers include: N-vinylpyrrolidone, allyl methacrylate, tetrahydrofurfuryl methacrylate, cyclohexyl methacrylate, n-hexyl methacrylate, cyclohexyl acrylate, 2-ethoxyethyl acrylate, 2-ethoxyethyl methacrylate, isodecyl methacrylate, 2-methoxyethyl acrylate, 2(2-ethoxyethoxy) ethylacrylate, stearyl acrylate, behenyl acrylate, nonyl phenol ethoxylate acrylate, tetrahydrofuranyl acrylate, lauryl methacrylate, stearyl methacrylate, octyl acrylate, lauryl acrylate, monomethoxy 1, 6-hexanediol acrylate, monomethoxy tripropylene glycol acrylate, monomethoxy neopentyl glycol propoxylate methyl acrylate, phenoxymethyl acrylate, 2-phenoxyethyl methacrylate, glycidyl methacrylate, isodecyl acrylate, isobornyl methacrylate, benzyl acrylate, hexyl acrylate, isooctyl acrylate, tridecyl methacrylate, caprolactone acrylate, isobornyl acrylate, triethylene glycol dimethacrylate, ethylene glycol dimethacrylate, tetraethylene glycol dimethacrylate, polyethylene glycol dimethacrylate, 1,3-butylene glycol diacrylate, 1,4-butenediol diacrylate, 1,4-butanediol dimethacrylate, diethylene glycol diacrylate, diethylene glycol dimethacrylate, 1,6-hexanediol diacrylate, 1,6-hexanediol dimethacrylate, 1,6-hexanediol diglycidyl ether, bisphenol A propoxylate diglycidyl ether, bisphenol A ethoxylate diglycidyl ether, neopentyl glycol propoxylate diglycidyl ether, neopentyl glycol diacrylate, neopentyl glycol propoxylate diacrylate, neopentyl glycol dimethacrylate, polyethylene glycol (200) diarylate, tetraethylene glycol diacrylate, triethylene glycol diacrylate dimethacrylate, 1,3-butylene glycol dimethacrylate, tripropylene glycol diacrylate, ethoxylated bisphenol A dimethacrylate, ethoxylated bisphenol A diacrylate, bisphenol A propoxylate diacrylate, tris(2-hydroxylethyl) isocyanurate trimethacrylate, pentaerythritol tetraacrylate, trimethylpropane trimethacrylate, trimethylpropane triacrylate, trimethylpropane propoxylate triacrylate, glyceryl propoxylate triacrylate, trimethylpropane ethoxylate triglycidyl ether, tris(2-hydroxy ethyl) isocyanurate triacrylate, dipentaerythritol pentaacrylate, pentaerythritol triacrylate, ethoxylated pentaerythritol tetraacrylate, polyethylene glycol (600) dimethacrylate, polyethylene glycol (600) diacrylate, polyethylene glycol (400) diacrylate, polypropylene glycol monmethacrylate, polypropylene glycol monacrylate, ditrimethylpropane tetraacrylate, ethoxylated trimethylpropane triacrylate, propoxylated trimethylpropane triacrylate, propoxylated neopentyl glycol diacrylate, glyceryl propoxy tricrylate, propoxylated glyceryl triacrylate, pentaacrylate ester, alkoxylated aliphatic diacrylate ester, alkoxylated trifunctional acrylate, trifunctional methacrylate ester, trifunctional acrylate ester, aliphatic monofunctional ester, aliphatic difunctional ester, alkoxylated diacrylate ester, polybutadiene diacrylate, aliphatic urethane acrylate, aromatic urethane acrylate, epoxy acrylate, bisphenol A epoxy diacrylate, and polyester acrylate.

Examples of suitable photoinitiators include: benzyldimethyl ketal, trimethylbenzophenone, isopropylthioxanthone, ethyl 4-(dimethylaminobenzoate), benzophenone, 2-hydroxy-2-methyl-1-phenyl-propan-1-one, 2,2 dimethoxy-2-phenylacetophenone, 2,2 dimethoxy-1,2-diphenyl ethanone, 2-hydroxy-2-methyl-1-phenyl propanone, and 2-methyl-1-(4-(methylthio)phenyl)-2-morpholinopropanone-1. The preferred photoinitiator is 1-hydroxycyclohexyl phenyl ketone.

The amount of the photoinitiator can range from 2% to 30%, by weight, preferably from 2% to 15% and, most preferably, from 5% to 10%.

Other conventional additives, such as wetting and dispersing agents or materials commonly used in heat-sensitive compositions other than those previously mentioned, can also be included in the radiation-curable overcoat composition without departing from the spirit of the invention.

The overcoat composition may be applied to the color-forming layer or to an intermediate layer that has been applied to the color-forming layer at a coating rate to yield a dry coverage of from about 0.2 to about 1.0 lb/MSF, preferably from about 0.50 to about 1.0 lb/MSF.

Following application of the overcoat composition as described above, the radiation-curable topcoat is cured by passing the coated member through an Aetek UV XL processor at a rate of about 100 to about 200 feet per minute. At 100 feet per minute, an overcoat composition such as that described in Example 3 of the previously mentioned U.S. Pat. No. 5,424,182 requires approximately 50 mj of energy to polymerize completely. One UV lamp at 300 watts per inch will achieve this energy level. Higher line speeds can be accomplished by using more lamps and increased wattage. Alternatively, conventional electron-beam curing can be employed.

U.S. Pat. Nos. 3,080,254, 3,031,329, 3,446,648 and 5,026,606, as previously described herein, teach various prior art compositions, structural configurations and process techniques known to the art which may be used with the present invention. The disclosures of these four patents are incorporated herein by reference.

The following examples are provided to further illustrate the invention. It should be understood that the purpose of the examples is to illustrate several embodiments of the invention and is in no way intended to limit the scope of the invention. Conventional additives for heat-sensitive compositions other than those previously mentioned can also be included in the composition without departing from the spirit of the invention.

Preparation of Base Coating Formulation

A base coating mix formulated having the following composition was prepared:

| Component | Wt. % of Total |
|---|---|
| Silver behenate | 43.6 |
| Phthalazone | 6.3 |
| 2-Mercaptobenzothiazole | 0.9 |
| Poly(vinyl alcohol) | 38.8 |
| Boric acid | 1.6 |
| Propyl gallate | 4.8 |
| Lupasol, FF-3249 dispersing agent | 3.9 |
| FC129 ™, surfactant | 0.1 |

The silver behenate, phthalazone, mercaptobenzothiazole, two-thirds of the poly(vinyl alcohol), and sufficient deionized water to give a 22% solids mixture were mixed and ground in an appropriate media mill until a mean particle size of about 1.5 μ was achieved. The boric acid was slowly stirred into the mixture, and into the resulting mixture was stirred a solution of propyl gallate, Lupasol™ FF-3249 dispersing agent (available from BASF Corp.), and the remaining one-third of the poly(vinyl alcohol) in enough deionized water to give a 22% solids mixture. The anionic fluorosurfactant, FC 129™, available from 3M Industrial Chemical Products Division, St. Paul, Minn., was then added, with stirring.

Preparation of Coating Formulations; Coating and Testing Procedures

A control coating formulation was prepared by diluting the base coating formulation with deionized water to give a mixture containing 18% solids. Water-soluble stabilizers were added to the base coating formulation as 5–10% solutions in deionized water; stabilizer concentrations ranged from ½ to 6% of total solids in the final mixes, which were adjusted to contain 18% of total solids with added deionized water. Water-insoluble stabilizers, together with about 5% of a supporting colloid such as poly(vinyl alcohol) or poly(vinyl pyrrolidone), were ground in an appropriate media mill until a mean particle size of about 1.5μ was achieved. These dispersions were added to the base coating formulation to give the desired concentrations of stabilizers, again about ½ to 6% of total solids, in final mixes adjusted to contain 18% of total solids.

The molar ratio of silver salt:stabilizer in the final coating mixes is preferably in the range from about 5:1 to 80:1, more preferably, from about 8:1 to 40:1.

The final mixes were coated on a subbed polyester film base with a spiral wire-bound rod of appropriate wire diameter to give a final coating weight of 1.9–2.0 lbs./1000 sq.ft. after drying. The color-forming layer was overcoated with a UV-curable, water-insoluble layer for imaging evaluation. Environmental stability was determined by measuring non-imagewise background density increases (BDI) after treatment for 24 hours in a 70° C./ambient humidity environment chamber. Sensitometry was determined by a conventional sensitometer designed for evaluation of thermal imaging media.

EXAMPLE 1

Coatings Containing Phosphoric Acid and Alkali Metal Phosphate Salt Stabilizers Coatings containing silver behenate and stabilizers phosphoric acid and mono-, di-, and tri-basic sodium phosphates, each in a 9:1 silver behenate:stabilizer molar ratio, were incubated for 24 hours at 70° C. and ambient humidity, after which treatment background density increases (BDI) were measured. The results are shown in Table 1 below:

TABLE 1

| | Stabilizer | BDI |
|---|---|---|
| control | None | +1.30 |
| invention | $H_3PO_4$ | +0.74 |
| invention | $NaH_2PO_4$ | +0.94 |
| invention | $Na_2HPO_4$ | +0.64 |
| invention | $Na_3PO_4$ | +0.45 |

All of the tested stabilizers yielded improved BDI relative to the control, the best results being obtained with $Na_3PO_4$. In an analogous test, the inclusion of $K_3PO_4$ in the same ratio as indicated above yielded an improvement similar to that produced by $Na_3PO_4$.

EXAMPLE 2

Coatings Containing Organic Phosphate Stabilizers

Two series of coating containing silver behenate and organic phosphate stabilizers, again in a 9:1 silver behenate: stabilizer ratio, were incubated for 24 hours at 70° C. and ambient humidity prior to BDI measurement. Test results are shown in Tables 2A and 2B below.

TABLE 2A

| | Stabilizer | BDI |
|---|---|---|
| control A | None | +1.53 |
| invention | F85-formula (II) | +0.33 |
| invention | Disodium glyceryl phosphate | +0.62 |
| invention | Sodium diphenyl phosphate | +0.84 |

TABLE 2B

| | Stabilizer | BDI |
|---|---|---|
| control B | None | +0.83 |
| invention | Sodium diphenyl phosphate | +0.35 |
| invention | Sodium bis(2-ethylhexyl) phosphate | +0.24 |

Two batches of silver behenate of different purities were employed in the preparation of coating series A and B. Substantial stabilization improvements were observed with all the organic phosphate compounds tested, the greatest improvement being obtained with stabilizer F85, represented by formula (II). Very good results were also obtained with sodium bis(2-ethylhexyl) phosphate. The reduction in background density increase produced by stabilizer F-85 is similar to the improvement produced by $Na_3PO_4$.

EXAMPLE 3

Effect of pH Adjustment on Stabilization by Phosphoric Acid and Alkali Phosphates Because it was recognized that addition of a phosphate salt to a coating mix could affect its pH, tests were carried out to ascertain the possible effect of pH adjustment on BDI. Silver salt:stabilizer ratios and incubation conditions were the same as employed in Examples 1 and 2. Test results for two series of coatings are shown in Tables 3A and 3B below.

TABLE 3A

| Test | Stabilizer | pH Adjustment Treatment | Final pH | BDI |
|---|---|---|---|---|
| 1 | None | None | 6.19 | +0.75 |
| 2 | None | add NaOH | 7.10 | +0.28 |
| 3 | None | add NaOH, then $HNO_3$ | 6.17 | +0.40 |
| 4 | $Na_3PO_4$ | None | 7.11 | +0.17 |
| 5 | $Na_3PO_4$ | add $HNO_3$ | 6.12 | +0.17 |

For the test results recorded in Table 3A, the stabilizer mix for the control coating had a pH of 6.19, and the control BDI was +0.75 (Test 1). Addition of NaOH to the control mix to raise the pH to 7.10 prior to coating resulted in a substantial improvement in BDI, which decreased to +0.28 (Test 2). When the pH of the Test 2 mix was adjusted back up to pH 6.17 by the addition of $HNO_3$ before coating, the BDI increased to +0.40 (Test 3). Thus, the observed BDI appears to have a significant dependence on pH.

The inclusion of $Na_3PO_4$ in the stabilizer mix, with a resulting pH of 7.11, led to a large drop in BDI, to +0.17 (test 4). Addition of $HNO_3$ to the $Na_3PO_4$-containing mix to lower its pH to 6.12, substantially equal to that of the Test 1 control and the Test 3 mixes, had no measurable effect on the BDI, which remained at the desirably low level of +0.17 (Table 5). These results demonstrate the substantial beneficial result of the phosphate stabilizer effect of the present invention.

TABLE 3B

| Test | Stabilizer | pH Adjustment Treatment | Final pH | BDI |
|---|---|---|---|---|
| 1 | None | None | 6.18, 6.19 | +0.63, +0.62 |
| 2 | None | add $Na_2CO_3$ | 7.10 | +0.18 |
| 3 | $Na_3PO_4$ | None | 7.10 | +0.17, +0.15 |
| 4 | $Na_3PO_4$ | add $HNO_3$ | 6.18 | +0.14 |
| 5 | $H_3PO_4$ | None | 5.42 | +0.22 |
| 6 | $H_3PO_4$ | add $Na_2CO_3$ | 5.99 | +0.23 |
| 7 | $H_3PO_4$ | add $Na_2CO_3$ | 7.11 | +0.14 |

For the test results recorded in Table 3B, the mixes used to prepare the control coatings had a pH of 6.18–6.19, and the control BDI was +0.63–+0.62 (Test 1). Addition of $Na_2CO_3$ to the control mix to raise the pH to 7.10 before coating resulted in a much improved BDI, +0.18 (Test 2). As noted previously with the results recorded in Table 3A, the stability of a dry silver thermal material against non-imagewise color formation is significantly dependent on the pH of the mix used for the color-forming layer.

A coating prepared from a $Na_3PO_4$-containing mix having a pH of 7.10 exhibited a very low BDI, +0.17–+0.15 (Test 3). Acidifying the mix to a pH of 6.18 by the addition of $HNO_3$ prior to coating yielded a slight lowering of the already low BDI, to a value of +0.14 (Test 4). This result clearly demonstrates a beneficial pH-independent phosphate stabilizer effect in the imaging material of the present invention.

A coating prepared from a mix containing $H_3PO_4$ and having a pH of 5.42 produced a BDI of 0.22 (Test 5), greatly superior to that of the control coating prepared from a pH 6.18 mix. Adding $Na_2CO_3$ to the $H_3PO_4$- containing mix before coating to raise the pH to 5.99 had little effect on the BDI (Test 6), but further $Na_2CO_3$ addition to increase the pH to 7.11 did result in a significant improvement, causing the BDI to fall to +0.14 (Test 7). This large increase in pH appears to have enhanced the already substantial desirable effect produced by the phosphate stabilizer included in the mix.

While the present invention has been described in terms of certain preferred embodiments and exemplified with respect thereto, one skilled in the art will readily appreciate that various modifications, changes, omissions and substitutions may be made without departing from the spirit thereof.

What is claimed:

1. A heat-sensitive imaging material comprising:

a support and a heat-sensitive imaging layer formed thereon, the imaging layer comprising:

a color-forming amount of a substantially colorless, finely divided solid noble metal salt of an organic acid;

an organic reducing agent that under conditions of heating is capable of a color-forming reaction with said noble metal salt, thereby producing a colored image;

an image toning agent; and a stabilizer compound that mitigates the formation of non-imagewise background color in said imaging layer, said stabilizer compound having the formula (I)

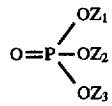

(I)

wherein $Z_1$, $Z_2$, and $Z_3$ each independently represents hydrogen, an alkali metal ion, an alkyl group comprising 1 to about 8 carbon atoms, an aralkyl or cycloalkyl group comprising 5 to about 10 carbon atoms, or an alkyl group comprising 6 to about 15 carbon atoms; or $Z_1$ and $Z_2$ together represent a divalent alkaline earth metal ion, a divalent alkylene group comprising 2 to about 8 carbon atoms, or a divalent aryl group comprising 6 to about 30 carbon atoms;

with the proviso that, when $Z_1$ and $Z_2$ together do not represent a divalent alkaline earth metal ion, at least one of $Z_1$, $Z_2$, and $Z_3$ represents hydrogen or an alkali metal ion.

2. The imaging material of claim 1 wherein $Z_1$ represents an alkali metal ion.

3. The imaging material of claim 2 wherein $Z_1$, $Z_2$, and $Z_3$ each represents an alkali metal ion.

4. The imaging material of claim 3 wherein said alkali metal ion is a sodium ion.

5. The imaging material of claim 1 wherein $Z_1$ and $Z_2$ together represents an divalent aryl group and $Z_3$ represents an alkali metal ion.

6. The imaging material of claim 5 wherein said stabilizer compound has the formula

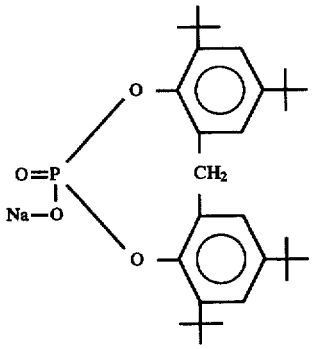

(II)

7. The imaging material of claim 1 wherein $Z_1$ represents an alkyl group comprising up to 6 carbon atoms and $Z_2$ represents an alkali metal ion.

8. The imaging material of claim 7 wherein $Z_1$ represents a 2-ethylhexyl or a bis(hydroxymethyl)methyl group and $Z_2$ represents a sodium ion.

9. The imaging material of claim 1 wherein said noble metal salt of an organic acid comprises silver behenate.

10. The imaging material of claim 1 wherein said organic reducing agent comprises an alkyl ester of gallic acid.

11. The imaging material of claim 10 wherein said alkyl ester of gallic acid comprises propyl gallate.

12. The imaging material of claim 1 wherein said image toning agent comprises phthalazone.

13. The imaging material of claim 1 wherein said support comprises a paper support or a polymeric film support.

14. The imaging material of claim 13 wherein said support comprises a transparent polyester film support.

15. The imaging material of claim 1 further comprising:

a protective layer formed over said heat-sensitive imaging layer.

16. The imaging material of claim 15 wherein said protective layer is a polymeric layer formed from a radiation-curable composition comprising one or more reactive monomers.

17. The imaging material of claim 16 wherein said reactive monomers comprise acrylic, vinyl, or glycidyl monomers.

18. The imaging material of claim 1 wherein said imaging layer contains said noble metal salt and said stabilizer compound in a molar ratio of from 5:1 to 80:1 metal salt:stabilizer.

19. The imaging material of claim 18 wherein said metal salt:stabilizer molar ratio is from 8:1 to 40:1.

* * * * *